US010488770B2

(12) United States Patent
Kuroiwa et al.

(10) Patent No.: US 10,488,770 B2
(45) Date of Patent: Nov. 26, 2019

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Ikuyo Kuroiwa, Tokyo (JP); Wataru Kitamura, Abiko (JP); Kumiko Takizawa, Saitama (JP); Tsuyoshi Shimada, Kashiwa (JP); Eileen Takeuchi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/135,181

(22) Filed: Sep. 19, 2018

(65) Prior Publication Data

US 2019/0094735 A1 Mar. 28, 2019

(30) Foreign Application Priority Data

Sep. 26, 2017 (JP) ..... 2017-185360

(51) Int. Cl.
*G03G 5/14* (2006.01)

(52) U.S. Cl.
CPC ..... *G03G 5/144* (2013.01)

(58) Field of Classification Search
CPC ..... G03G 5/144
See application file for complete search history.

(56) References Cited

U.S. PATENT DOCUMENTS 5,198,685 A 3/1993 Kitani et al.
5,506,082 A * 4/1996 Nguyen ..... G03G 5/0542 430/56
5,876,890 A 5/1999 Kitamura et al.
5,912,098 A 6/1999 Tanaka et al.
(Continued)

FOREIGN PATENT DOCUMENTS

JP 2001-75296 3/2001
JP 2005-242155 9/2005

OTHER PUBLICATIONS

U.S. Appl. No. 15/946,208, Ikuyo Kuroiwa, filed Apr. 5, 2018.
(Continued)

*Primary Examiner* — Christopher D Rodee
(74) *Attorney, Agent, or Firm* — Venable LLP

(57) ABSTRACT

There is provided an electrophotographic photosensitive member, a process cartridge and an electrophotographic apparatus in which residual potential is suppressed and a ghost image is prevented from being generated in a low-humidity environment in an undercoat layer of the electrophotographic photosensitive member. An electrophotographic photosensitive member including: an undercoat layer containing a strontium titanate particle having a maximum peak at a position of $2\theta=32.20\pm0.20$ ($\theta$ represents a Bragg angle) in a CuK$\alpha$ characteristic X-ray diffraction pattern and a half-value width of the maximum peak of 0.10 deg or more and 0.50 deg or less, and a titanium oxide particle; and a photosensitive layer containing a polyvinyl butyral resin, and a process cartridge and an electrophotographic apparatus each provided with the electrophotographic photosensitive member.

7 Claims, 5 Drawing Sheets

(56) References Cited

U.S. PATENT DOCUMENTS

| | | | | |
|---|---|---|---|---|
| 6,405,005 | B1 | 6/2002 | Kitamura et al. | |
| 6,696,214 | B2 | 2/2004 | Katayama et al. | |
| 7,645,547 | B2 | 1/2010 | Okuda et al. | |
| 7,655,370 | B2 | 2/2010 | Kitamura et al. | |
| 7,813,675 | B2 | 10/2010 | Tanabe et al. | |
| 9,766,561 | B2 | 9/2017 | Takahashi et al. | |
| 9,791,792 | B2 | 10/2017 | Miyauchi et al. | |
| 9,811,012 | B2 | 11/2017 | Murakami et al. | |
| 9,817,324 | B2 | 11/2017 | Kitamura et al. | |
| 9,971,258 | B2 | 5/2018 | Kitamura et al. | |
| 9,983,490 | B2 | 5/2018 | Shimada et al. | |
| 10,042,273 | B2 | 8/2018 | Takahashi et al. | |
| 10,241,429 | B2 * | 3/2019 | Shimada | G03G 15/75 |
| 2014/0004450 | A1 | 1/2014 | Tokimitsu et al. | |
| 2018/0314173 | A1 * | 11/2018 | Shimada | G03G 15/75 |
| 2019/0033739 | A1 * | 1/2019 | Yamagishi | G03G 9/09708 |

OTHER PUBLICATIONS

U.S. Appl. No. 15/958,464, Eileen Takeuchi, filed Apr. 20, 2018.
U.S. Appl. No. 15/960,916, Tsuyoshi Shimada, filed Apr. 24, 2018.

* cited by examiner

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus each including the electrophotographic photosensitive member.

Description of the Related Art

In recent years, as an organic electrophotographic photosensitive member (hereinafter, referred to as "electrophotographic photosensitive member"), an electrophotographic photosensitive member including: an undercoat layer containing a metal oxide particle; and a photosensitive layer formed on the undercoat layer has been used.

As the metal oxide particle contained in the undercoat layer of the electrophotographic photosensitive member, various metal oxide particles are proposed.

In Japanese Patent Application Laid-Open No. 2001-75296, an undercoat layer containing a dendrite-shaped titanium oxide particle having a major axis length of 10 μm or less, a minor axis length of 0.5 μm or less and a volume resistance of a powdered dendrite-shaped titanium oxide being $10^5$ to $10^{10}$ Ω·cm is proposed as a metal oxide particle. According to this literature, it is reported that such an undercoat layer provides an effect of achieving reduced residual potential in a low-humidity environment.

Japanese Patent Application Laid-Open No. 2005-242155 discloses a strontium titanate and the like of a titanate as a metal oxide particle contained in the undercoat layer from the viewpoint of electrical properties.

SUMMARY OF THE INVENTION

According to studies conducted by the present inventors, it has been found that in the case where a strontium titanate particle having a particular X-ray diffraction pattern is used as the metal oxide particle in the undercoat layer of the electrophotographic photosensitive member, electrical properties, especially the residual potential can be improved to be further excellent and a ghost image can be prevented from being generated in a low-humidity environment.

An object of the present invention is to provide: an electrophotographic photosensitive member that is effective in reducing residual potential and preventing a ghost image from being generated in a low-humidity environment by using a strontium titanate particle having a particular X-ray diffraction pattern and a titanium oxide particle as a metal oxide particle in an undercoat layer of the electrophotographic photosensitive member; and a process cartridge and an electrophotographic apparatus each including the electrophotographic photosensitive member.

The electrophotographic photosensitive member of the present invention capable of achieving the above-described object, includes a support; an undercoat layer; and a photosensitive layer in the mentioned order, in which the undercoat layer contains a binder resin, a titanium oxide particle and a strontium titanate particle, the strontium titanate particle has a maximum peak at a position of 2θ=32.20±0.20 (θ represents a Bragg angle) in a CuKα characteristic X-ray diffraction pattern, a half-value width of the maximum peak is 0.10 deg or more and 0.50 deg or less, and the photosensitive layer contains a polyvinyl butyral resin.

According to the present invention, an electrophotographic photosensitive member that suppresses residual potential and prevents a ghost image from being generated can be provided by using a strontium titanate particle having a particular X-ray diffraction pattern and a titanium oxide particle.

Further features of the present invention will become apparent from the following description of exemplary embodiments with reference to the attached drawings.

DESCRIPTION OF THE EMBODIMENTS

Figure 1:
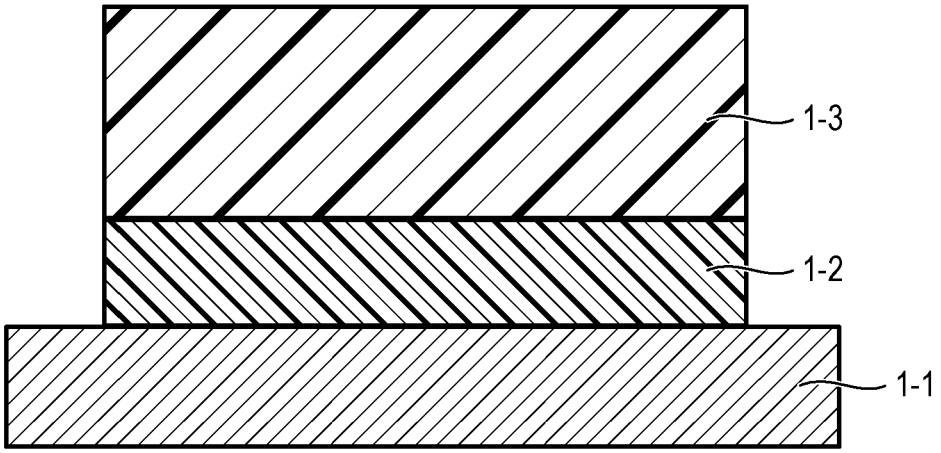
FIG. 1 is a diagram illustrating an example of a layer constitution of an electrophotographic photosensitive member according to the present invention.

Preferred embodiments of the present invention will now be described in detail in accordance with the accompanying drawings.

In an electrophotographic photosensitive member and a process cartridge and an electrophotographic apparatus each including the electrophotographic photosensitive member of the present invention, an undercoat layer of the electrophotographic photosensitive member contains a strontium titanate particle. The strontium titanate particle to be used has a maximum peak at a position of 2θ=32.20±0.20 (θ represents a Bragg angle) in a CuKα characteristic X-ray diffraction pattern, and a half-value width of the maximum peak is 0.10 deg or more and 0.50 deg or less.

The present inventors have conducted diligent studies to find that it is very important to control the half-value width of the strontium titanate particle to 0.10 deg or more and 0.50 deg or less, preferably 0.10 deg or more and 0.35 deg or less.

In general, the half-value width of a diffraction peak in powder X-ray diffraction has a relationship with a crystallite diameter of an inorganic fine particle. A grain of a primary particle is constituted by a plurality of crystallites, and the crystallite diameter refers to the size of an individual crystallite that constitutes the primary particle.

In the present invention, the crystallite denotes an individual crystallite that constitutes a particle, and the crystallites aggregate to make a particle. The size of the crystallite and the particle diameter of the particle have no relation with each other.

In general, when the crystallite diameter of an inorganic fine particle is small, the half-value width of a diffraction peak in powder X-ray diffraction becomes large, and when the crystallite diameter of an inorganic fine particle is large, the half-value width of a diffraction peak in powder X-ray diffraction becomes small.

When the crystallite diameter of an inorganic fine particle becomes large, grain boundaries between crystallites (crystal grain boundaries) that are present in a primary particle decrease. It is considered that the crystal grain boundary is a point where a charge is trapped. A charge easily flows in a crystallite of an inorganic fine particle, and thus the less the crystal grain boundaries are present in the trap point, the easier the charge flows. In the case where the undercoat layer of the electrophotographic photosensitive member contains a strontium titanate particle, when the crystallite diameters of the crystallites of the strontium titanate particle are sufficiently large, the crystal grain boundaries decrease to suppress excessive storage of charges, and therefore the residual potential can be reduced.

Accordingly, it is important to adjust the crystal grain boundaries of the strontium titanate particle appropriately in order to suitably reduce the residual potential.

Therefore, the present inventors consider that by controlling the half-value width of the maximum peak of the strontium titanate particle to 0.10 deg or more and 0.50 deg or less, an electrophotographic photosensitive member that can suppress the residual potential and prevent the ghost image from being generated in a low-humidity environment can be obtained.

The strontium titanate particle according to the present invention has a maximum peak at a position of $2\theta=32.20\pm0.20$ ($\theta$ represents a Bragg angle) in a CuK$\alpha$ characteristic X-ray diffraction pattern, and the half-value width of the maximum peak is 0.10 deg or more and 0.50 deg or less.

When the half-value width is less than 0.10 deg, the crystal grain boundaries of the strontium titanate particle is decreased as described above, which leads to an increase in electro-conductivity and thus causes an increase in black spots due to leakage of the charge from the undercoat layer to the support.

In addition, when the half-value width is larger than 0.50 deg, the strontium titanate particle does not contain a crystallite having a sufficient size as described above, and therefore the residual potential becomes large.

A particle diameter of the strontium titanate particle according to the present invention is not particularly limited but a number average primary particle diameter is preferably 10 nm or more and 300 nm or less from the viewpoint of electrical properties.

The strontium titanate particle according to the present invention may be surface-treated with a surface treating agent and is preferably surface-treated using a silane coupling agent. Particularly, the silane coupling agent more preferably has at least one functional group selected from the group consisting of alkyl groups, amino groups, and halogen groups from the viewpoint of electrical properties.

Further, the undercoat layer of the electrophotographic photosensitive member according to the present invention also contains a titanium oxide particle. This is because an adhesion improvement of a boundary between an undercoat layer containing a strontium titanate particle and a photosensitive layer provided above the undercoat layer is taken into consideration. The undercoat layer containing a titanium oxide particle tends to have better adhesion than that of the undercoat layer containing a strontium titanate particle only. The present inventors consider that the reason why the titanium oxide particle provides an increased adhesion is as follows.

The titanium oxide particle has hydrophobicity smaller than that of the strontium titanate particle, that is, the titanium oxide particle has a high hydrophilic property. For that reason, when a resin included in the photosensitive layer provided above the undercoat layer contains a large amount of hydrophilic groups, it blends in with the titanium oxide on a surface of the resin, and this improves the adhesion of the boundary between the undercoat layer and the photosensitive layer. In the present invention, as the titanium oxide particle, a particle having a number average primary particle diameter of 10 nm or less is used, and for example, TKP-101 is preferably used.

As a photosensitive drum, there is also a configuration having a cleaning blade for recovering a residual toner after transferring, and a roller for adjusting a gap between a drum and a development sleeve. It is considered that peeling-off of a film is unlikely to occur at the boundary between the undercoat layer and the photosensitive layer provided above the undercoat layer only by applying a pressing force with a rubber-made cleaning blade which is commonly used in the electrophotographic configuration. However, if the blade is made of a harder material, adhesion at the boundary between the undercoat layer and the photosensitive layer provided above the undercoat layer needs to be fully considered. The same is true for the case where a configuration has a gap adjusting roller made of a hard material such as a plastic that is actively in contact with the photosensitive drum.

In the present invention, the strontium titanate particle having a half-value width of the diffraction peak in the X-ray diffraction of 0.10 deg or more and 0.50 deg or less is contained in the undercoat layer, and the ghost image is prevented from being generated in a low-humidity environment. Further, by mixing the titanium oxide particle to make a polyvinyl butyral resin contained in the charge generating layer provided above the undercoat layer have a hydrophilic property, the photosensitive drum of which the adhesion at the boundary between the undercoat layer and the charge generating layer of the photosensitive layer is fully considered is provided.

[Electrophotographic Photosensitive Member]

The electrophotographic photosensitive member according to the present invention includes, for example, an undercoat layer on a support and further, a photosensitive layer on the undercoat layer, as illustrated in FIG. 1. In FIG. 1, reference numeral 1-1 denotes the support, and reference numeral 1-2 denotes the undercoat layer, and reference numeral 1-3 denotes the photosensitive layer.

A method for producing the electrophotographic photosensitive member according to the present invention includes a method in which coating liquids for respective layers, which will be describe later, are prepared to conduct coating in the desired order of layers to be dried. In this method, a method for conducting coating with the coating liquids includes a dip coating method, a spray coating method, an inkjet coating method, a roll coating method, a die coating method, a blade coating method, a curtain coating method, a wire bar coating method, and a ring coating method. Among these coating methods, the dip coating method is preferable from the viewpoint of efficiency and productivity.

<Support>

The electrophotographic photosensitive member according to the present invention includes a support, and the support is preferably an electro-conductive support having electro-conductivity. In addition, examples of the shape of the support include a cylindrical shape, a belt shape and a sheet shape. Among these shapes, the support is preferably a cylindrical support. Further, an electrochemical treatment such as anodic oxidation, blast treatment or cutting treatment may be applied on the surface of the support, but blast treatment or cutting treatment is preferably performed.

The material of the support is preferably metals, resins, glass, and the like.

Examples of the metals include aluminum, iron, nickel, copper, gold, stainless steel and alloys thereof. Among these metals, the support is preferably an aluminum support using aluminum.

In addition, electro-conductivity may be imparted to resins and glass through a treatment such as mixing or coating with an electro-conductive material.

<Electro-Conductive Layer>

In the present invention, an electro-conductive layer may be provided on the support. When the electro-conductive layer is provided, scratches and unevenness on the surface of the support can be concealed, and reflection of light at the surface of the support can be controlled.

The electro-conductive layer preferably contains an electro-conductive particle and a resin.

Examples of the material of the electro-conductive particle include metal oxides, metals, and carbon black.

Examples of the metal oxides include zinc oxide, aluminum oxide, indium oxide, silicon oxide, zirconium oxide, tin oxide, titanium oxide, magnesium oxide, antimony oxide, and bismuth oxide. Examples of the metals include aluminum, nickel, iron, nichrome, copper, zinc, and silver.

Among these materials, metal oxides are preferably used as the electro-conductive particle, and particularly, titanium oxide, tin oxide, and zinc oxide are more preferably used.

In the case where the metal oxide is used as the electro-conductive particle, the surface of the metal oxide may be treated with a silane coupling agent or the like, or the metal oxide may be doped with an element such as phosphorus or aluminum, or an oxide thereof.

In addition, the electro-conductive particle may be made to have a laminated structure including a core material and an enveloping layer that envelopes the particle. Examples of the core material include titanium oxide, barium sulfate, and zinc oxide. Examples of the enveloping layer include metal oxides such as tin oxide.

Moreover, in the case where the metal oxide is used as the electro-conductive particle, the metal oxide preferably has a volume average particle diameter of 1 nm or more and 500 nm or less, more preferably 3 nm or more and 400 nm or less.

Examples of the resin include polyester resins, polycarbonate resins, polyvinyl acetal resins, acrylic resins, silicone resins, epoxy resins, melamine resins, polyurethane resins, phenolic resins, and alkyd resins.

In addition, the electro-conductive layer may further contain a concealing agent such as silicone oil, a resin particle, or titanium oxide.

The average thickness of the electro-conductive layer is preferably 1 μm or more and 50 μm or less, particularly preferably 3 μm or more and 40 μm or less.

The electro-conductive layer can be formed in such a way that a coating liquid for an electro-conductive layer, the coating liquid containing the above-described respective materials and a solvent, is prepared, and a coating film of the coating liquid is formed on the support and then dried. Examples of the solvent to be used for the coating liquid include alcohol-based solvents, sulfoxide-based solvents, ketone-based solvents, ether-based solvents, ester-based solvents and aromatic hydrocarbon-based solvents. Examples of the method of dispersing the electro-conductive particle in the coating liquid for an electro-conductive layer include a method using a paint shaker, a sand mill, a ball mill or a liquid collision type high-speed disperser.

<Undercoat Layer>

In the present invention, the undercoat layer is provided on the support or the electro-conductive layer.

The undercoat layer included in the electrophotographic photosensitive member according to the present invention contains the above-described strontium titanate particle and a titanium oxide particle, and further a binder resin.

The titanium oxide particle and the strontium titanate particle preferably have the following content rate.

It is preferable that a total content of the strontium titanate particle and the titanium oxide particle in the undercoat layer is 70% by mass or more based on a metal oxide content in the undercoat layer, and a content of the titanium oxide particle MTi and a content of the strontium titanate particle MSr in the undercoat layer satisfy the following formula (mass ratio):

$$0.25 \leq MSr/MTi \leq 9.0.$$

The mass ratio of smaller than 0.25 reduces an effect of suppressing a residual charge of the strontium titanate particle, and a negative ghost image is likely to be generated in a low-humidity environment. The mass ratio of larger than 9.0 leads to an increase in electro-conductivity and thus causes an increase in black spots due to the leakage of the charge from the undercoat layer to the support.

Examples of the binder resin include polyester resins, polycarbonate resins, polyvinyl acetal resins, acrylic resins, epoxy resins, melamine resins, polyurethane resins, phenolic resins, polyvinyl phenolic resins, alkyd resins, polyvinyl alcohol resins, polyethylene oxide resins, polypropylene oxide resins, polyamide resins, polyamide acid resins, polyimide resins, polyamideimide resins and cellulose resins.

The binder resin may be prepared by subjecting a composition containing a monomer having a polymerizable functional group to polymerization. Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic anhydride group and a carbon-carbon double bond group.

In addition, the undercoat layer according to the present invention may further contain an electron accepting substance, an electron transporting substance, a metal oxide, a metal, an electro-conductive polymer, and the like for the purpose of enhancing electrical properties.

Examples of the electron accepting substance include quinone compounds, anthraquinone compounds, phthalocyanine compounds, porphyrin compounds, triphenylmethane compounds, fluorenylidenemalononitrile compounds and benzalmalononitrile compounds.

Examples of the electron transporting substance include quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds and boron-containing compounds. The undercoat layer may be formed as a cured film by using as the electron transporting substance an electron transporting substance having a polymerizable functional group and copolymerizing the electron transporting substance having a polymerizable functional group with the above-described monomer having a polymerizable functional group.

Examples of the metal oxide include indium tin oxide, tin oxide, indium oxide, zinc oxide, aluminum oxide and silicon dioxide. Examples of the metal include gold, silver and aluminum.

Examples of the electro-conductive polymer include polyaniline, polypyrrole and polythiophene.

The undercoat layer according to the present invention can further contain additives.

The average film thickness of the undercoat layer according to the present invention is preferably 0.1 μm or more and 40 μm or less, more preferably 0.5 μm or more and 20 μm or less.

The undercoat layer according to the present invention can be formed in such a way that a coating liquid for an undercoat layer, the coating liquid containing the above described respective materials and a solvent, is prepared, and a coating film of this coating liquid is formed on the support or the electro-conductive layer and is then dried and/or cured. Examples of the solvent to be used for the coating liquid include alcohol-based solvents, ketone-based solvents, ether-based solvents, ester-based solvents and aromatic hydrocarbon-based solvents.

<Photosensitive Layer>

The electrophotographic photosensitive member according to the present invention includes a photosensitive layer on the undercoat layer.

A photosensitive layer of an electrophotographic photosensitive member is mainly classified into (1) a lamination type photosensitive layer and (2) a monolayer type photosensitive layer. (1) The lamination type photosensitive layer includes: a charge generating layer containing a charge generating substance; and a charge transporting layer containing a charge transporting substance. (2) The monolayer type photosensitive layer is a photosensitive layer containing both a charge generating substance and a charge transporting substance.

(1) Lamination Type Photosensitive Layer

The lamination type photosensitive layer includes a charge generating layer and a charge transporting layer.

(1-1) Charge Generating Layer

The charge generating layer preferably contains a charge generating substance and a resin.

Examples of the charge generating substance include azo pigments, perylene pigments, polycyclic quinone pigments, indigo pigments and phthalocyanine pigments. Among these pigments, azo pigments and phthalocyanine pigments are preferable. Among phthalocyanine pigments, oxytitanium phthalocyanine pigments, chlorogallium phthalocyanine pigments and hydroxy gallium phthalocyanine pigments are preferable.

The content of the charge generating substance in the charge generating layer is preferably 40% by mass or more and 85% by mass or less, more preferably 60% by mass or more and 80% by mass or less based on the total mass of the charge generating layer.

The resins are preferably polyvinyl butyral resins.

In addition, the charge generating layer may further contain an additive or additives such as an antioxidant and an ultraviolet absorber. Specific examples of the additives include hindered phenol compounds, hindered amine compounds, sulfur compounds, phosphorus compounds and benzophenone compounds.

The average film thickness of the charge generating layer is preferably 0.1 μm or more and 1 μm or less, more preferably 0.15 μm or more and 0.4 μm or less.

The charge generating layer can be formed in such a way that a coating liquid for a charge generating layer, the coating liquid containing the above-described respective materials and a solvent, is prepared, and a coating film of this coating liquid is formed and is then dried. Examples of the solvent to be used for the coating liquid include alcohol-based solvents, sulfoxide-based solvents, ketone-based solvents, ether-based solvents, ester-based solvents and aromatic hydrocarbon-based solvents.

(1-2) Charge Transporting Layer

The charge transporting layer preferably contains a charge transporting substance and a resin.

Examples of the charge transporting substance include polycyclic aromatic compounds, heterocyclic compounds, hydrazone compounds, styryl compounds, enamine compounds, benzidine compounds, triarylamine compounds and resins having a group derived from these substances. Among these compounds, triarylamine compounds and benzidine compounds are preferable.

The content of the charge transporting substance in the charge transporting layer is preferably 25% by mass or more and 70% by mass or less, more preferably 30% by mass or more and 55% by mass or less based on the total mass of the charge transporting layer.

Examples of the resin include polyester resins, polycarbonate resins, acrylic resins and polystyrene resins. Among these resins, polycarbonate resins and polyester resins are preferable. As polyester resins, polyarylate resins are particularly preferable.

The content ratio (mass ratio) of the charge transporting substance to the resin is preferably 4:10 to 20:10, more preferably 5:10 to 12:10.

In addition, the charge transporting layer may contain an additive or additives such as antioxidant, an ultraviolet absorber, a plasticizer, a levelling agent, a sliding property-imparting agent and wear resistance-improving agent. Specific examples of the additives include hindered phenol compounds, hindered amine compounds, sulfur compounds, phosphorus compounds, benzophenone compounds, siloxane-modified resins, silicone oils, a fluororesin particle, a polystyrene resin particle, a polyethylene resin particle, a silica particle, an alumina particle and a boron nitride particle.

The average film thickness of the charge transporting layer is preferably 5 μm or more and 50 μm or less, more preferably 8 μm or more and 40 μm or less, and particularly preferably 10 μm or more and 30 μm or less.

The charge transporting layer can be formed in such a way that a coating liquid for a charge transporting layer, the coating liquid containing the above-described respective materials and a solvent, is prepared, and a coating film of this coating liquid is formed on the charge generating layer and is then dried. Examples of the solvent to be used for the coating liquid include alcohol-based solvents, ketone-based solvents, ether-based solvents, ester-based solvents and aromatic hydrocarbon-based solvents. Among these solvents, ether-based solvents or aromatic hydrocarbon-based solvents are preferable.

(2) Monolayer Type Photosensitive Layer

The monolayer type photosensitive layer can be formed in such a way that a coating liquid for a photosensitive layer, the coating liquid containing a charge generating substance, a charge transporting substance, a resin, and a solvent, is prepared, and a coating film of this coating liquid is formed on the undercoat layer and is then dried. As the charge generating substance, the charge transporting substance and the resin, a polyvinyl butyral resin is preferably used as in the above-described "(1-1) charge generating layer" of "(1) Lamination type photosensitive layer".

<Protective Layer>

In the present invention, a protective layer may be provided on the photosensitive layer. When the protective layer is provided, durability can be improved.

The protective layer preferably contains: an electro-conductive particle and/or a charge transporting substance; and a resin.

Examples of the electro-conductive particle include a particle of a metal oxide such as titanium oxide, zinc oxide, tin oxide or indium oxide.

Examples of the charge transporting substance include polycyclic aromatic compounds, heterocyclic compounds, hydrazone compounds, styryl compounds, enamine compounds, benzidine compounds, triarylamine compounds and resins having a group derived from these substances. Among these substances, triarylamine compounds and benzidine compounds are preferable.

Examples of the resin include polyester resins, acrylic resins, phenoxy resins, polycarbonate resins, polystyrene resins, phenolic resins, melamine resins and epoxy resins. Among these resins, polycarbonate resins, polyester resins and acrylic resins are preferable.

In addition, the protective layer may be formed as a cured film by subjecting a composition containing a monomer having a polymerizable functional group to polymerization. Examples of the reaction for the polymerization include a thermal polymerization reaction, a photopolymerization reaction and a radiation polymerization reaction. Examples of the polymerizable functional group of the monomer having a polymerizable functional group include an acrylic group and a methacrylic group. As the monomer having a polymerizable functional group, a material having charge transporting ability may be used.

The protective layer may contain an additive or additives such as an antioxidant, an ultraviolet absorber, a plasticizer, a levelling agent, a sliding property-imparting agent and a wear resistance-improving agent. Specific examples of the additives include hindered phenol compounds, hindered amine compounds, sulfur compounds, phosphorus compounds, benzophenone compounds, siloxane-modified resins, silicone oils, a fluororesin particle, a polystyrene resin particle, a polyethylene resin particle, a silica particle, an alumina particle and a boron nitride particle.

The average film thickness of the protective layer is preferably 0.5 μm or more and 10 μm or less, preferably 1 μm or more and 7 μm or less.

The protective layer can be formed in such a way that a coating liquid for a protective layer, the coating liquid containing the above-described respective materials and a solvent, is prepared, and a coating film of this coating liquid is formed on the photosensitive layer and is then dried and/or cured. Examples of the solvent to be used for the coating liquid include alcohol-based solvents, ketone-based solvents, ether-based solvents, sulfoxide-based solvents, ester-based solvents and aromatic hydrocarbon-based solvents.

<Surface Processing of Electrophotographic Photosensitive Member>

With respect to the electrophotographic photosensitive member according to the present invention, roughness can be imparted by providing concave portions or convex portions on the surface layer of the electrophotographic photosensitive member or by polishing the surface layer for the purpose of further stabilizing the behavior of a cleaning unit (cleaning blade) that is to be brought into contact with the electrophotographic photosensitive member.

In the case where the concave portions are formed, a mold having convex portions corresponding to the concave portions is pressed into contact with the surface of the electrophotographic photosensitive member to perform shape transfer, and the concave portions can be thereby formed on the surface of the electrophotographic photosensitive member.

In the case where the convex portions are formed, a mold having concave portions corresponding to the convex portions is pressed into contact with the surface of the electrophotographic photosensitive member to perform shape transfer, and the convex portions can be thereby formed on the surface of the electrophotographic photosensitive member.

In the case where the roughness is imparted by polishing the surface layer of the electrophotographic photosensitive member, a polishing tool is pressed into contact with the electrophotographic photosensitive member, either one or both of the polishing tool and the electrophotographic photosensitive member are relatively moved to polish the surface of the electrophotographic photosensitive member, and the roughness can be thereby imparted. Examples of the polishing tool include a polishing member provided with a layer on a base material, the layer containing an abrasive grain dispersed in a binder resin.

[Process Cartridge and Electrophotographic Apparatus]

A process cartridge according to the present invention integrally supports: an electrophotographic photosensitive member described above; and at least one unit selected from the group consisting of a charging unit, a developing unit, a transfer unit and a cleaning unit and is detachably attachable to an electrophotographic apparatus main body.

In addition, an electrophotographic apparatus according to the present invention includes: an electrophotographic photosensitive member described above; a charging unit; an exposing unit; a developing unit; and a transfer unit.

Moreover, the electrophotographic photosensitive apparatus according to the present invention includes as the charging unit: a charging roller disposed on the electrophotographic photosensitive member described above so as to be in contact with the electrophotographic photosensitive member; and a charging unit that charges the electrophotographic photosensitive member by applying only direct-current voltage to the charging roller.

Figure 2:
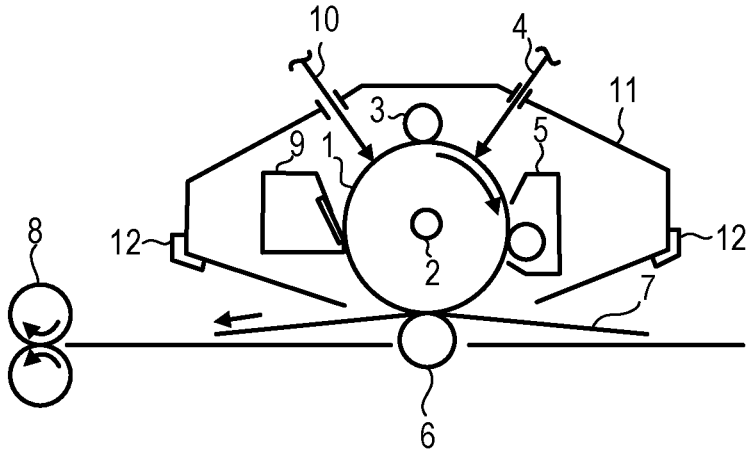
FIG. 2 is a diagram illustrating an example of an electrophotographic apparatus provided with a process cartridge including an electrophotographic photosensitive member according to the present invention.

FIG. 2 illustrates an example of an outline constitution of an electrophotographic apparatus including a process cartridge provided with an electrophotographic photosensitive member.

Reference numeral 1 denotes a cylindrical electrophotographic photosensitive member and is rotationally driven around a shaft 2 in the direction of the arrow at a predetermined circumferential speed. The surface of the electrophotographic photosensitive member 1 is charged at a predetermined positive or negative potential by a charging unit 3. It is to be noted that the figure illustrates a roller charging system using a roller type charging member; however, a charging system such as a corona charging system, a proximity charging system or an injection charging system may be adopted. In the case of the roller charging system, there exist a DC charging system in which voltage to be applied to a roller type charging member is only direct-current voltage and an AC/DC charging system in which alternating-current voltage is superposed on direct-current voltage; however, the charging system is preferably the DC charging system from the viewpoint of reducing apparatus cost and miniaturizing an apparatus. The surface of the charged electrophotographic photosensitive member 1 is irradiated with exposing light 4 from an exposing unit (not illustrated in figure) and an electrostatic latent image corresponding to the intended image information is formed. The electrostatic latent image formed on the surface of the electrophotographic photosensitive member 1 is developed by a toner stored in a developing unit 5 and a toner image is formed on the surface of the electrophotographic photosensitive member 1. The toner image formed on the surface of the electrophotographic photosensitive member 1 is transferred to a transfer material 7 by a transfer unit 6. The transfer material 7 to which the toner image has been transferred is conveyed to a fixing unit 8 where the transfer material 7 is subjected to a treatment for fixing the toner image, and the transfer material 7 is then printed out outside the electrophotographic apparatus. The electrophotographic apparatus may include a cleaning unit 9 for removing deposits such as a toner left on the surface of the electrophotographic photosensitive member 1 after the transfer of the toner image. In addition, a so-called cleanerless system in which a cleaning unit is not provided separately and the deposits are removed by the developing unit or the like may be used. The electrophotographic apparatus may include an electricity removing mechanism that performs an electricity removing treatment on the surface of the electrophotographic photosensitive member 1 by pre-exposing light 10 from a pre-exposing unit (not illustrated in figure). Moreover, a guide unit 12 such as a rail may be provided for attachment/detachment of the process cartridge 11 according to the present invention to/from the electrophotographic apparatus main body.

The electrophotographic photosensitive member according to the present invention can be used for a laser beam printer, an LED printer, a copying machine, facsimile equipment and a multifunctional machine thereof, and the like.

EXAMPLES

Hereinafter, the present invention will be described in more detail using Examples and Comparative Examples. The present invention is not limited by the following Examples within a range not exceeding the scope of the present invention. It is to be noted that "parts" in the description of Examples below are each on a mass basis unless otherwise noted.

Method for Producing Strontium Titanate Particle

Production Example for Particle S-1

A water-containing titanium oxide slurry obtained by subjecting a titanyl sulfate aqueous solution to hydrolysis was washed with an alkaline solution.

Subsequently, hydrochloric acid was added to the water-containing titanium oxide slurry to adjust the pH to 0.7, and thus a titania sol dispersion liquid was obtained.

To 0.6 mol (in terms of titanium oxide) of the titania sol dispersion liquid, a strontium chloride aqueous solution in a molar quantity of 1.2 times the molar quantity of the titania sol dispersion liquid was added. A resultant mixture was put into a reaction vessel and the air inside the vessel was replaced with a nitrogen gas. Further, 0.05 mol of aluminum sulfate was added to the mixture and pure water was then added so that the resultant mixture has a titanium oxide concentration of 0.3 mol/L.

Subsequently, the mixture was stirred and mixed, and was warmed to 80° C. Thereafter, 450 mL of a 2 N sodium hydroxide aqueous solution was added to the mixture over 5 minutes while ultrasonic vibration was applied to the mixture, and the reaction was then performed for 20 minutes. To a slurry after the reaction, pure water of 5° C. was added to quench the slurry until the temperature reached 30° C. or lower, and the supernatant liquid was then removed. Further, the slurry was washed with pure water and obtained cake was dried to obtain a particle S-1.

Production Example for Particle S-2

To 2.2 mol (in terms of titanium oxide) of the titania sol dispersion liquid, a strontium chloride aqueous solution in a molar quantity of 1.1 times the molar quantity of the titania sol dispersion liquid was added. A resultant mixture was put into a reaction vessel and the air inside the vessel was replaced with a nitrogen gas.

Further, pure water was added to the mixture so that a resultant mixture has a concentration of 1.1 mol/L in terms of titanium oxide.

Subsequently, the mixture was stirred and mixed, and was warmed to 90° C. Thereafter, 440 mL of a 10 N sodium hydroxide aqueous solution was added to the mixture over 15 minutes while ultrasonic vibration was applied to the mixture, and the reaction was then performed for 20 minutes.

To a slurry after the reaction, pure water of 5° C. was added to quench the slurry until the temperature reached 30° C. or lower, and the supernatant liquid was then removed.

Further, a hydrochloric acid aqueous solution having a pH of 5.0 was added to the slurry and a resultant mixture was stirred for 1 hour. Thereafter, washing with pure water was repeated. Further, the mixture was neutralized with sodium hydroxide to perform filtration with a Nutsche funnel, and a residue was washed with pure water. Obtained cake was dried to obtain a particle S-2.

Production Example for Particle S-3

To 2.2 mol (in terms of titanium oxide) of the titania sol dispersion liquid, a strontium chloride aqueous solution in a molar quantity of 0.98 times the molar quantity of the titania sol dispersion liquid was added. A resultant mixture was put into a reaction vessel and the air inside the vessel was replaced with a nitrogen gas.

Further, pure water was added to the mixture so that the resultant mixture has 0.5 mol/L in terms of titanium oxide.

Subsequently, a resultant mixture was stirred and mixed, and was warmed to 80° C. Thereafter, a 10 N sodium hydroxide aqueous solution was added to adjust pH of the mixture to 5.0 while ultrasonic vibration was applied to the mixture, and the reaction was then performed for 20 minutes.

To a slurry after the reaction, pure water of 5° C. was added to cool the temperature of the slurry to 30° C. or lower, and the supernatant liquid was then removed.

Further, the mixture was neutralized with sodium hydroxide to perform filtration with a Nutsche funnel, and residue was washed with pure water. Obtained cake was dried to obtain a particle S-3.

Production Example for Particle S-4

To 1.8 mol (in terms of titanium oxide) of the titania sol dispersion liquid, a strontium chloride aqueous solution in a molar quantity of 1.1 times the molar quantity of the titania sol dispersion liquid was added. A resultant mixture was put into a reaction vessel and the air inside the vessel was replaced with a nitrogen gas. Further, pure water was added to the mixture so that a resultant mixture has a titanium oxide concentration of 0.9 mol/L.

Subsequently, the mixture was stirred and mixed, and was warmed to 80° C. Thereafter, 792 mL of a 5 N sodium hydroxide aqueous solution was added to the mixture over 40 minutes while ultrasonic vibration was applied to the mixture, and the reaction was then performed for 20 minutes. A slurry after the reaction was quenched until the temperature reached 30° C. or lower, and the supernatant liquid was then removed. Further, a hydrochloric acid aqueous solution having a pH of 5.0 was added to the slurry and a resultant mixture was stirred for 1 hour. Thereafter, washing with pure water was repeated. Further, the mixture was neutralized with sodium hydroxide to perform filtration with a Nutsche funnel, and a residue was washed with pure water. Obtained cake was dried to obtain a particle S-4.

Production Example for Particle S-5

To 1.8 mol (in terms of titanium oxide) of the titania sol dispersion liquid, a strontium chloride aqueous solution in a molar quantity of 1.1 times the molar quantity of the titania sol dispersion liquid was added. A resultant mixture was put into a reaction vessel and the air inside the vessel was replaced with a nitrogen gas. Further, pure water was added to the mixture so that a resultant mixture has a titanium oxide concentration of 0.9 mol/L.

Subsequently, the mixture was stirred and mixed, and was warmed to 85° C. Thereafter, 576 mL of a 5 N sodium hydroxide aqueous solution was added to the mixture over 5 minutes while ultrasonic vibration was applied to the mixture, and the reaction was then performed for 20 minutes. To a slurry after the reaction, pure water of 5° C. was added to quench the slurry until the temperature reached 30° C. or lower, and the supernatant liquid was then removed. Further, a hydrochloric acid aqueous solution having a pH of 5.0 was added to the slurry and a resultant mixture was stirred for 1 hour. Thereafter, washing with pure water was repeated. Further, the mixture was neutralized with sodium hydroxide to perform filtration with a Nutsche funnel, and a residue was washed with pure water. Obtained cake was dried to obtain a particle S-5.

Production Example for Particle S-6

To 0.6 mol (in terms of titanium oxide) of the titania sol dispersion liquid, a strontium chloride aqueous solution in a molar quantity of 1.2 times the molar quantity of the titania sol dispersion liquid was added. A resultant mixture was put into a reaction vessel and the air inside the vessel was replaced with a nitrogen gas. Further, 0.05 mol of aluminum sulfate was added to the mixture and pure water was then added so that the resultant mixture has a titanium oxide concentration of 0.3 mol/L.

Subsequently, the mixture was stirred and mixed, and was warmed to 80° C. Thereafter, 450 mL of a 2 N sodium hydroxide aqueous solution was added to the mixture over 5 minutes while ultrasonic vibration was applied to the mixture, and the reaction was then performed for 20 minutes. To a slurry after the reaction, pure water of 5° C. was added to quench the slurry until the temperature reached 30° C. or lower, and the supernatant liquid was then removed. Further, the slurry was washed with pure water and obtained cake was dried to obtain a particle S-6.

X-ray diffraction measurement and average primary particle diameter measurement of the produced particles S-1 to S-6 were conducted. The results are shown in Table 1.

TABLE 1

| Strontium titanate particle | Half-value width [deg] | Particle diameter [nm] |
|---|---|---|
| Particle S-1 | 0.18 | 100 nm |
| Particle S-2 | 0.10 | 110 nm |
| Particle S-3 | 0.23 | 50 nm |
| Particle S-4 | 0.33 | 35 nm |
| Particle S-5 | 0.50 | 50 nm |
| Particle S-6 | 0.55 | 110 nm |

Production Examples for Surface-Treated Strontium Titanate Particle

Production Example of Surface-Treated Particle S-1A

With 500 parts of toluene, 100 parts of the produced particle S-1 was stirred and mixed, and 2 parts of N-2-(aminoethyl)-3-aminopropylmethyldimethoxysilane (trade name: KBM602, manufactured by Shin-Etsu Chemical Co., Ltd.) was added as a silane coupling agent thereto and a resultant mixture was stirred for 6 hours. Thereafter, toluene was distilled away under reduced pressure and a residue was dried by heating at 130° C. for 6 hours to obtain a surface-treated particle S-1A.

Production Example for Surface-Treated Particle S-1B

A surface-treated particle S-1B was produced in the same manner as in Production Example for the particle S-1A except that the amount of the silane coupling agent added was changed to 0.75 parts in Production Example for Surface-Treated Particle S-1A.

Production Example for Surface-Treated Particle S-1C

A surface-treated particle S-1C was produced in the same manner as in Production Example for the particle S-1A except that the amount of the silane coupling agent added was changed to 5 parts in Production Example for Surface-Treated Particle S-1A.

Production Example for Surface-Treated Particle S-1D

A surface-treated particle S-1D was produced in the same manner as in Production Example for the particle S-1A except that the silane coupling agent was changed to N-2-(aminoethyl)-3-aminopropyltrimethoxysilane (trade name: KBM603, manufactured by Shin-Etsu Chemical Co., Ltd.) in Production Example for Surface-Treated Particle S-1A.

Production Example for Surface-Treated Particle S-1E

A surface-treated particle S-1E was produced in the same manner as in Production Example for the particle S-1A except that the silane coupling agent was changed to 4.6 parts of isobutyltrimethoxysilane and 4.6 parts of trifluoropropylmethoxysilane in Production Example for Surface-Treated Particle S-1A.

Production Examples for Surface-Treated Particles S-2A to S-6A

Surface-treated particles S-2A to S-6A were produced in the same manner as in Production Example for the particle S-1A except that the particle S-1 was changed to the particles S-2 to S-6 in Production Example for Surface-Treated Particle S-1A.

Example 1

An aluminum cylinder having a length of 357.5 mm, a thickness of 0.7 mm and an outer diameter of 30 mm was prepared as a support (electro-conductive support). Cut processing was performed on the surface of the prepared aluminum cylinder using a lathe.

Processing was performed under conditions of using a cutting tool of R0.1 at a number of revolutions of the main shaft=10000 rpm and continuously changing the feeding speed of the cutting tool in the range of 0.03 to 0.06 mm/rpm.

Subsequently, 15 parts of a butyral resin (trade name: BM-1, manufactured by Sekisui Chemical Co., Ltd.) as a polyol resin and 15 parts of blocked isocyanate (trade name: Sumidule 3175, manufactured by Sumika Bayer Urethane Co., Ltd.) were dissolved in a mixed liquid of 300 parts of methyl ethyl ketone and 300 parts of 1-butanol.

To this solution, 80 parts of the particle S-1A as a strontium titanate particle, 40 parts of the titanium oxide T-1 (trade name: TKP-101, manufactured by Titan Kogyo, Ltd.) and 1.2 parts of 2,3,4-trihydroxybenzophenone (manufactured by Tokyo Chemical Industry Co., Ltd.) as an additive were added, and a resultant mixture was dispersed with a sand mill apparatus which uses a glass bead having a diameter of 0.8 mm under an atmosphere of 23±3° C. for 3 hours.

After the dispersion, 0.01 parts of a silicone oil (trade name: SH 28 PA, manufactured by Dow Corning Toray Co., Ltd.) was added to the dispersion liquid and a resultant mixture was stirred to prepare a coating liquid for an undercoat layer.

The support was dip-coated with the obtained coating liquid for an undercoat layer and was dried at 160° C. for 30 minutes to form an undercoat layer having a film thickness of 2.0 μm.

Subsequently, in a sand mill which uses a glass bead having a diameter of 1 mm, 20 parts of a hydroxy gallium phthalocyanine crystal (charge generating substance) of a crystal form having strong peaks at a Bragg angle 20±0.2° of 7.4° and of 28.2° in CuKα characteristic X-ray diffraction, 0.2 parts of the calixarene compound represented by the following formula (A), 10 parts of a polyvinyl butyral resin (trade name: S-LEC BX-1, manufactured by Sekisui Chemical Co., Ltd.) and 600 parts of cyclohexanone were placed and were subjected to a dispersion treatment for 4 hours. Thereafter, 600 parts of ethyl acetate was added thereto to prepare a coating liquid for a charge generating layer.

The undercoat layer was dip-coated with the coating liquid for a charge generating layer and a coating film obtained was dried at 80° C. for 15 minutes to form a charge generating layer having a film thickness of 0.19 μm.

(A)

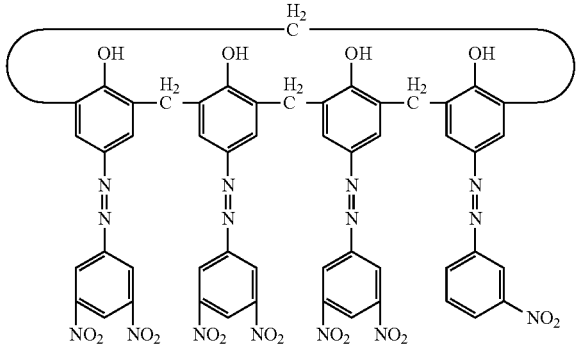

Subsequently, 60 parts of the compound (charge transporting substance) represented by the following formula (B), 30 parts of the compound (charge transporting substance) represented by the following formula (C), 10 parts of the compound (D) represented by the following formula, 100 parts of a polycarbonate resin (trade name: Iupilon Z400, manufactured by Mitsubishi Engineering-Plastics Corporation, bisphenol Z type polycarbonate) and 0.02 parts of the polycarbonate represented by the following formula (E) (viscosity average molecular weight Mv: 20000)

were dissolved in a mixed solvent of 600 parts of o-xylene and 200 parts of dimethoxymethane to prepare a coating liquid for a charge transporting layer.

The charge generating layer was dip-coated with the coating liquid for a charge transporting layer to form a coating film and the obtained coating film was dried at 100° C. for 30 minutes to form a charge transporting layer having a film thickness of 18

(B)

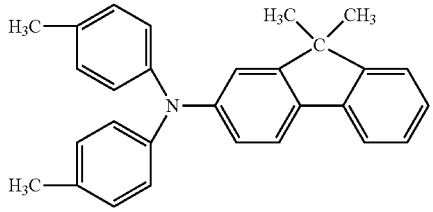

(C)

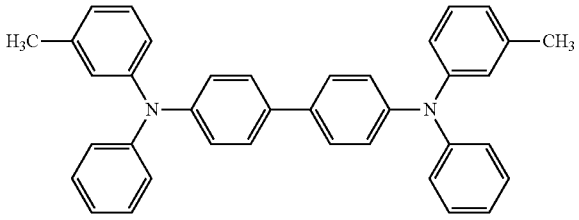

-continued (D)

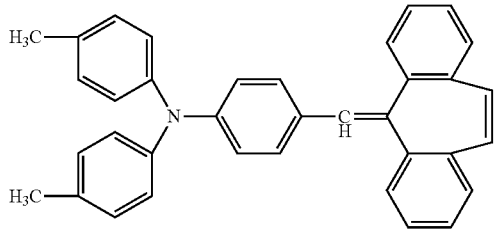

(E)

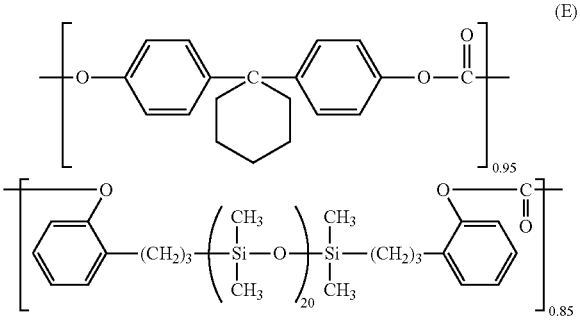

Subsequently, 1.65 parts of a resin having the repeating structural unit represented by the following formula (F1) and the repeating structural unit represented by the following formula (F2) (weight average molecular weight: 130,000, copolymerization ratio (F1)/(F2)=1/1 (molar ratio))

was dissolved in a mixed solvent of 40 parts of 1,1,2,2,3,3,4-heptafluorocyclopentane (trade name: ZEORORA H, manufactured by Zeon Corporation) and 55 parts of 1-propanol.

Thereafter, a liquid obtained by adding to a resultant solution 30 parts of a tetrafluoroethylene resin powder (trade name: Lubron L-2, manufactured by Daikin Industries, Ltd.) was allowed to pass through a high-pressure disperser (trade name: Microfluidizer M-110EH, manufactured by Microfluidics Corp.) to obtain a dispersion liquid.

Thereafter, 52.0 parts of the positive hole transporting compound represented by the following formula (G), 16.0 parts of the compound represented by the following formula (H) (ARONIX M-315, manufactured by Toagosei Co., Ltd.), 2.0 parts of the compound represented by the following formula (I) (manufactured by Sigma-Aldrich Co. LLC), 0.75 parts of a siloxane-modified acrylic compound (BYK-3550, manufactured by BYK Japan KK), 35 parts of 1,1,2,2,3,3,4-heptafluorocyclopentane and 15 parts of 1-propanol were added to the dispersion liquid and a resultant liquid was filtrated with a polyflon filter (trade name: PF-040, manufactured by Advantec Toyo Kaisha, Ltd.) to prepare a coating liquid for a protective layer.

The charge transporting layer was dip-coated with the coating liquid for a protective layer and an obtained coating film was dried at 40° C. for 5 minutes. After the drying, the coating film was irradiated with an electron beam for 1.6 seconds under a nitrogen atmosphere under conditions of an acceleration voltage of 70 KV and an absorbed dose of 15 kGy. Thereafter, a heat treatment was performed for 15 seconds under a nitrogen atmosphere under conditions for making the temperature of the coating film 135° C. It is to be noted that the oxygen concentration from the irradiation with the electron beam to the heat treatment of 15 seconds was 15 ppm. Subsequently, a heat treatment was performed in the air for 1 hour under conditions for making the temperature of the coating film 105° C. to form a protective layer having a film thickness of 5 μm. The electrophotographic photosensitive member was prepared in this manner.

(F1)

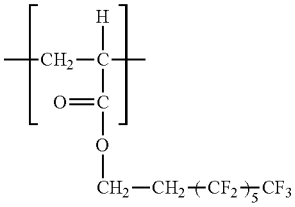

(F2)

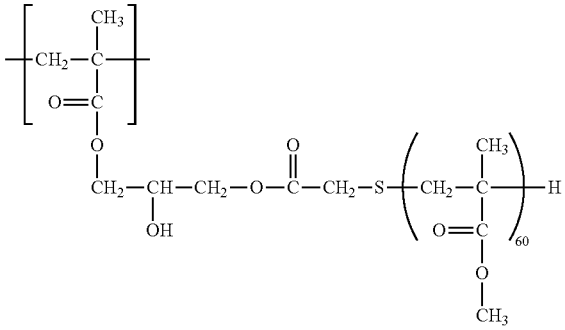

(G)

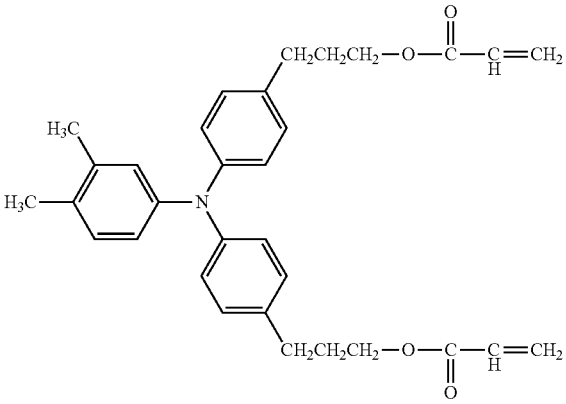

(H)

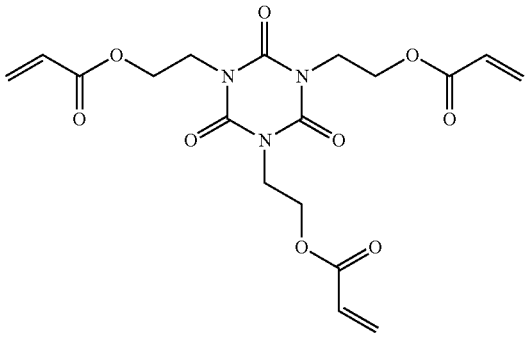

(I)

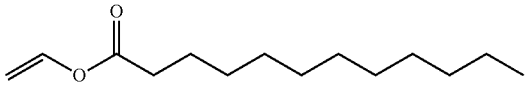

[Formation of Concave Portions Through Mold Press-Contact Shape Transfer]

Subsequently, a mold member (mold) is installed in a press-contact shape transfer processing apparatus and surface processing was performed on the prepared electrophotographic photosensitive member before the formation of concave portions.

Figure 4A:
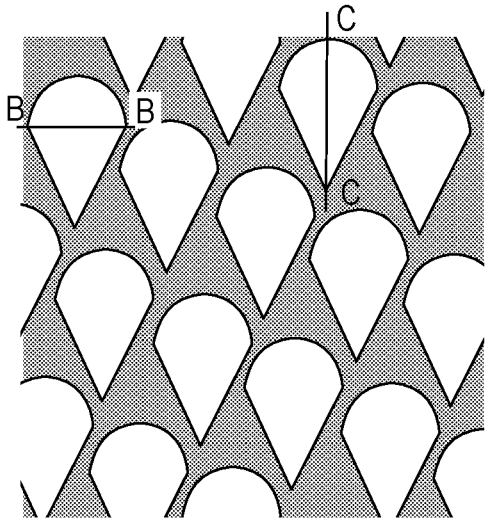
FIG. 4A is a top view illustrating a mold used in Production Examples of an electrophotographic photosensitive member.
Figure 4B:
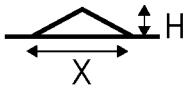
FIG. 4B is a B-B sectional view of convex portions of the mold illustrated in FIG. 4A.
Figure 4C:
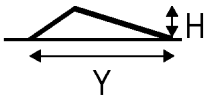
FIG. 4C is a C-C sectional view of convex portions of the mold illustrated in FIG. 4A.
Figure 5:
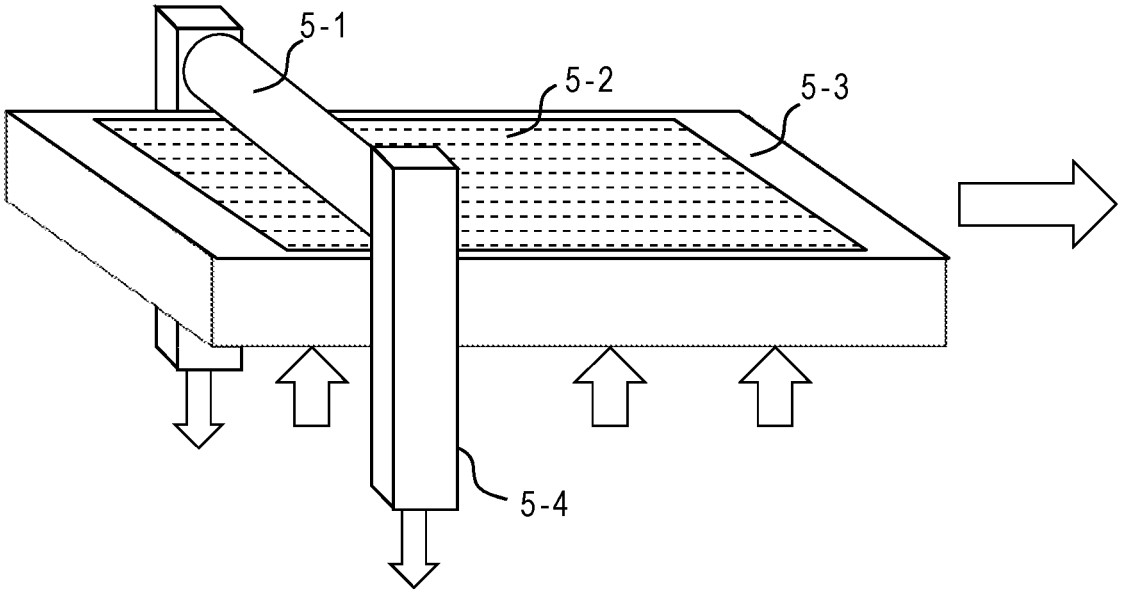
FIG. 5 is a diagram illustrating an example of a press-contact shape transfer processing apparatus for forming concave portions at a circumferential face of an electrophotographic photosensitive member.

Specifically, a mold illustrated in FIGS. 4A to 4C was installed in a press-contact shape transfer processing apparatus having a constitution as roughly illustrated in FIG. 5 and surface processing was performed on the prepared electrophotographic photosensitive member before the formation of concave portions. FIGS. 4A to 4C are diagrams illustrating the mold used in Examples and Comparative Examples. FIG. 4A is a top view illustrating the outline of the mold and FIG. 4B is a schematic sectional view of the convex portions of the mold in the direction of the shaft of the electrophotographic photosensitive member (sectional view in B-B section in FIG. 4A). FIG. 4C is a sectional view of the convex portions of the mold in the direction of the circumference of the electrophotographic photosensitive member (sectional view in C-C section in FIG. 4A). The mold illustrated in FIGS. 4A to 4C has convex shapes having a maximum width (refers to the maximum width in the direction of the shaft of the electrophotographic photosensitive member when a convex portion on the mold is viewed from above) X: 50 μm, a maximum length (refers to the maximum length in the direction of the circumference of the electrophotographic photosensitive member when a convex portion on the mold is viewed from above) Y: 75 μm, an area ratio of 56% and a height H: 4 μm. It is to be noted that the area ratio refers to a ratio of the area of the convex portions in the whole surface when the mold is viewed from above. During processing, the temperatures of the electrophotographic photosensitive member and the mold were controlled so that the temperature of the surface of the electrophotographic photosensitive member was 120° C. The electrophotographic photosensitive member was rotated in the circumferential direction while the electrophotographic photosensitive member and the pressure member were pressed to the mold at a pressure of 7.0 MPa, and the concave portions were thereby formed on the whole surface of the surface layer (circumferential face) of the electrophotographic photosensitive member.

An electrophotographic photosensitive member of Example 1 was prepared in the manner as described above.

FIG. 5 illustrates a body to be processed (the electrophotographic photosensitive member before being processed) as 5-1, a mold as 5-2, a pressure member as 5-3 and a support member as 5-4.

[Evaluation of Electrophotographic Photosensitive Member]

As an electrophotographic apparatus for evaluation, a modified machine of a copying machine imageRUNNER ADVANCE C3330 manufactured by Canon Inc. was used. Evaluation was conducted using as a charging unit a system of applying direct-current voltage to a roller type contact charging member (charging roller).

The evaluation apparatus was installed under an environment of a temperature of 15° C. and a relative humidity of 5% RH. Measurement of the surface potential of the electrophotographic photosensitive member was conducted by taking out a developing cartridge from the evaluation apparatus and inserting a potential measurement apparatus therein. The potential measurement apparatus is configured by disposing a potential measurement probe at a developing position of the developing cartridge and the position of the potential measurement probe was at the center of the electrophotographic photosensitive member in the bus line.

When evaluating the residual potential, the voltage Vc to be applied to a charging member (charging roller) was adjusted such that a dark part potential Vd was −700 V. The laser light quantity was adjusted so that bright part potential V1 was −200 V when irradiation with laser light having a wavelength of 780 nm was performed and residual potential was evaluated after 10 sheets of a solid black image were printed out. The results are shown in Table 2.

The residual potential was evaluated as an excellent level (AA) when the residual potential measured under the above evaluation conditions was −50 V or less, as an acceptable level for practical use (A) when the residual potential was −100 V or less and as an unacceptable level at which a problem may occur in practical use (B) when the residual potential was more than −100 V.

Further, a potential difference ΔVh between a first round and a second round of halftone potential was measured to evaluate a ghost level for comparison. The results are shown in Table 1. The ghost level was evaluated as an excellent level (AA) when ΔVh was in the range of ±10 V, as an acceptable level for practical use (A) when ΔVh was in the range of ±15 V and as an unacceptable level at which a problem may occur in practical use (B) when ΔVh was outside the range of ±15 V.

[Preparation of Sample Sheet]

An aluminum cylinder wrapped with an aluminum sheet having a thickness of 50 μm was used as a support in place of the aluminum cylinder in Example 1. An undercoat layer, a charge generating layer and a charge transporting layer were formed on the support in this order in the same manner as in the method for preparing the electrophotographic photosensitive member described in Example 1. After that, a film peeling test, which is described below, was performed on a sample sheet SS-1A of Example 1 prepared by peeling the aluminum sheet off the aluminum cylinder.

[Film Peeling (Adhesion) Test]

The prepared sample sheet SS-1A of the undercoat layer was left to stand in a high temperature and high humidity environment which is at a temperature of 50° C. and a humidity of 90% RH for 72 hours. The sample sheet was taken out. After that, the undercoat layer was left to stand in a normal temperature and normal humidity environment which is at a temperature of 23° C. and a humidity of 50% RH to dry a wet sheet surface of the undercoat layer such that a tape to be used in the following film peeling test is firmly adhered to the sheet surface, and the film peeling test was performed 24 hours later.

The film peeling test was performed by a cross-cut taping method according to JIS-K5400. The regulations of JIS should be followed regarding the items that are not particularly specified. Measurement steps are described as follows.

1: The sample sheet was secured, and cuts that get to the aluminum sheet were made on the film with a space of 2 mm between each cut using a cross-cut guide to leave cuts in a grid-like form. A grid pattern having 100 cells was formed.

2: A new cutter was always used when leaving cuts, and a certain angle in the range of 35 to 45 degree was kept relative to the coating surface. In addition, the cuts were made at a constant speed of about 0.5 seconds per a cut such that the cuts penetrate through the coating film and get to the aluminum sheet.

3: An adhesive cellophane tape was taped on the coating film surface that has been cut, which was then rubbed with an eraser to stick the tape to the coating film. After sticking the tape for 1 to 2 minutes, the tape was peeled off instantaneously by holding one end of the tape and keeping a right angle relative to the coating surface.

4: The coating surface and the tape were observed to determine the number of grid cells that have been peeled off and calculate a percentage of a peeled-off area. In the film peeling test, a cross-cut test was performed on the sample sheet by the method described in JIS, and the number of remaining grid cells among 100 cells were counted. A percentage of grid cells of which the film remained unpeeled was calculated. The calculation was performed by the following formula: adhesion rate (%)=the number of unpeeled cells (cells)/the total number (100 cells). The evaluation results are shown in Table 2.

The adhesion of the charge generating layer was evaluated as an excellent level (AA) when the adhesion rate measured under the above evaluation conditions was 90% or more, as an acceptable level for practical use (A) when the adhesion rate was 80% or more and less than 90% and as an unacceptable level at which a problem may occur in practical use (B) when the adhesion rate was 70% or more and less than 80%.

Examples 2 to 5

Electrophotographic photosensitive members and sample sheets of Examples 2 to 5 were each prepared in the same manner as in Example 1 except that the strontium titanate particle S-1A used for the coating liquid for an undercoat layer in Example 1 was changed to the respective particles S-2A to 5A, and the evaluation of the residual potential, the ghost level and the adhesion was conducted. The results are shown in Table 2.

Example 6

An electrophotographic photosensitive member and a sample sheet of Example 6 were prepared in the same manner as in Example 1 except that the mixing ratio of the strontium titanate particle and the titanium oxide particle used for the coating liquid for an undercoat layer in Example 1 was changed to the ratio below, and the evaluation of the residual potential, the ghost level and the adhesion was conducted.

96 parts of strontium titanate particle S-1A
24 parts of titanium oxide particle T-1
The results are shown in Table 2.

Example 7

An electrophotographic photosensitive member and a sample sheet of Example 7 were prepared in the same manner as in Example 1 except that the mixing ratio of the strontium titanate particle and the titanium oxide particle used for the coating liquid for an undercoat layer in Example 1 was changed to the ratio below, and the evaluation of the residual potential, the ghost level and the adhesion was conducted.

12 parts of strontium titanate particle S-1A
108 parts of titanium oxide particle T-1
The results are shown in Table 2.

Examples 8 to 11

An electrophotographic photosensitive members and sample sheets of Examples 8 to 11 were each prepared in the same manner as in Example 1 except that the strontium titanate particle S-1A used for the coating liquid for an undercoat layer in Example 1 was changed to the respective particle S-1, particle S-1B, particle S-1C and particle S-1D, and the evaluation of the residual potential, the ghost level and the adhesion was conducted. The results are shown in Table 2.

Example 12

An electrophotographic photosensitive member and a sample sheet of Example 12 were prepared in the same manner as in Example 1 except that the titanium oxide particle T-1 used for the coating liquid for an undercoat layer in Example 1 was changed to trade name: ATO (manufactured by Titan Kogyo, Ltd.), and the evaluation of the residual potential, the ghost level and the adhesion was conducted. The results are shown in Table 2.

Example 13

100 parts of the titanium oxide particle T-1 used for the coating liquid for an undercoat layer in Example 1 was stirred and mixed with 500 parts of toluene, then 1.25 parts of N-2-(aminoethyl)-3-aminopropylmethyldimethoxysilane was added therein and the mixture was stirred for 2 hours. After that, toluene was distilled off under reduced pressure and a resultant was fired at 120° C. for 3 hours to obtain a surface treated titanium oxide particle T-1A. An electrophotographic photosensitive member and a sample sheet of Example 13 were prepared in the same manner as in Example 1 except that the titanium oxide particle T-1 was changed to the titanium oxide particle T-1A, and the evaluation of the residual potential, the ghost level and the adhesion was conducted. The results are shown in Table 2.

Example 14

An electrophotographic photosensitive member and a sample sheet of Example 14 were prepared in the same manner as in Example 1 except that 15 parts of the butyral resin and 15 parts of the blocked isocyanate each used for the coating liquid for an undercoat layer in Example 1 were changed to 30 parts of an alcohol-soluble copolymerized polyamide (trade name: Amilan CM8000, manufactured by Toray Industries, Inc.), and 300 parts of methyl ethyl ketone in Example 1 was changed to 300 parts of methanol, and the evaluation of the residual potential, the ghost level and the adhesion was conducted. The results are shown in Table 2.

Example 15

An electrophotographic photosensitive member and a sample sheet of Example 15 were prepared in the same manner as in Example 1 except that a film thickness of the undercoat layer in Example 1 was changed from 2.0 μm to 5.0 μm, and the evaluation of the residual potential, the ghost level and the adhesion was conducted. The results are shown in Table 2.

Example 16

An electrophotographic photosensitive member and a sample sheet of Example 16 were prepared in the same manner as in Example 1 except that the film thickness of the undercoat layer in Example 1 was changed from 2.0 μm to 18 μm, and the evaluation of the residual potential, the ghost level and the adhesion was conducted. The results are shown in Table 2.

Example 17

An electrophotographic photosensitive member of Example 17 was prepared in the same manner as in Example 1 except that the surface processing of the electrophotographic photosensitive member in Example 1 was changed to processing using the polishing apparatus described below, and the evaluation of the residual potential, the ghost level and the adhesion was conducted. The results are shown in Table 2.

The surface of the electrophotographic photosensitive member before surface polishing was polished. The polishing was performed using the polishing apparatus illustrated in FIG. 3 under the following conditions.

Feeding speed of polishing sheet; 400 mm/min

Number of rotations of electrophotographic photosensitive member; 450 rpm

Pushing of electrophotographic photosensitive member into backup roller; 3.5 mm

Directions of rotation of polishing sheet and electrophotographic photosensitive member; with Backup roller; outer diameter of 100 mm and Asker C hardness of 25

A polishing sheet 101 to be attached to the polishing apparatus was prepared by mixing abrasive grains which are used in GC3000 and GC2000 each manufactured by RIKEN CORUNDUM CO., LTD.

GC3000 (surface roughness Ra of polishing sheet of 0.83 μm)

GC2000 (surface roughness Ra of polishing sheet of 1.45 μm)

Polishing sheet 101 (surface roughness Ra of polishing sheet of 1.12 μm)

The time for polishing using the polishing sheet 101 was 20 seconds.

Figure 3:
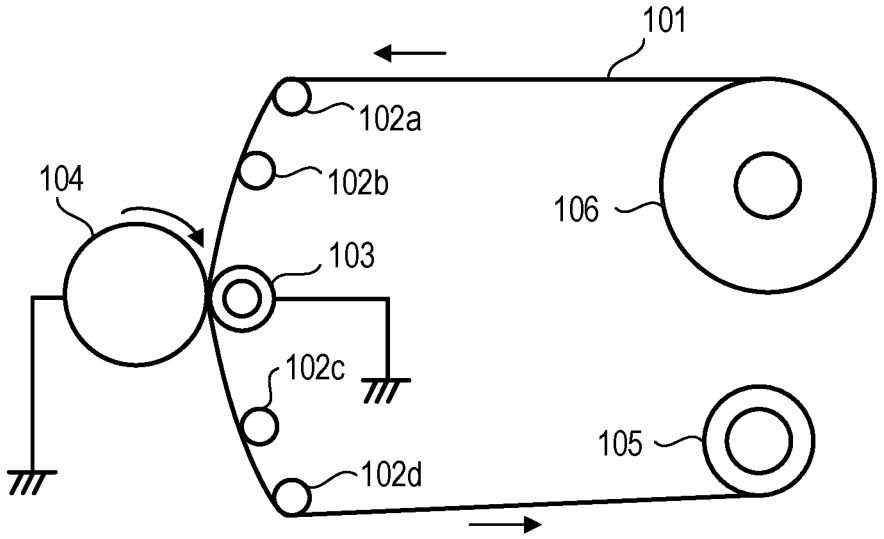
FIG. 3 is a diagram illustrating an example of a polishing machine using a polishing sheet.

FIG. 3 illustrates a guide roller as 102*a*, a guide roller as 102*b*, a backup roller as 103, body to be processed (electrophotographic photosensitive member before polishing) as 104, a winding unit as 105 and a hollow shaft as 106.

Example 18

An electrophotographic photosensitive member and a sample sheet of Example 18 were prepared in the same manner as in Example 1 except that the surface layer (protective layer) in Example 1 was not provided and the charge transporting layer was formed by the method described below, and the evaluation of the residual potential, the ghost level and the adhesion was conducted. The results are shown in Table 2.

72 parts of the compound represented by the above formula (B) (charge transporting substance), 8 parts of the compound represented by the above formula (D) (charge transporting substance), 100 parts of a resin having a structure represented by the following formula (J), 1.8 parts of a resin having a structure represented by the following formula (K), 360 parts of o-xylene, 160 parts of methyl benzoate and 270 parts of dimethoxymethane (methylal)

were mixed, and a resultant mixture was used as a coating liquid for a charge transporting layer.

Subsequently, the charge generating layer was dip-coated with the coating liquid for a charge transporting layer, and an obtained coating film was dried at 125° C. for 50 minutes to form a charge transporting layer having a film thickness of 20 μm.

(J)

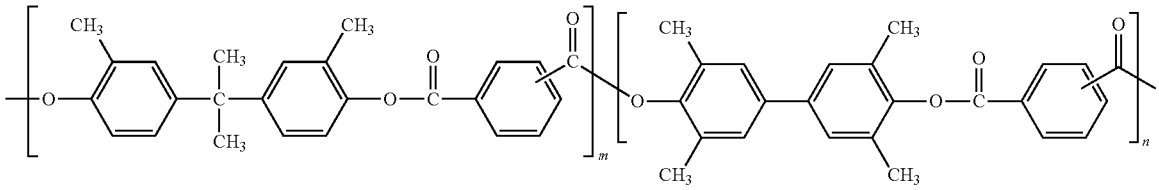

(K)

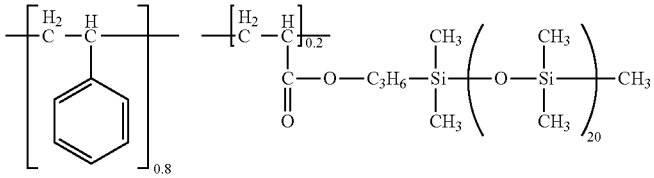

(In formula (J) and formula (K), m and n denote a copolymerization ratio, and m:n=7:3)

Example 19

An electrophotographic photosensitive member and a sample sheet of Example 19 were prepared in the same manner as in Example 1 except that a coating liquid for a surface layer (coating liquid for protective layer), the coating liquid prepared by the method described below, was used in the formation of the surface layer (protective layer) in Example 1, and the evaluation of the residual potential, the ghost level and the adhesion was conducted. The results are shown in Table 2.

In a mixed solvent of 45 parts of 1,1,2,2,3,3,4-heptafluorocyclopentane (trade name: ZEORORA H, manufactured by Zeon Corporation) and 45 parts of 1-propanol, 1.5 parts of a fluorine atom-containing resin (trade name: GF-300, manufactured by Toagosei Co., Ltd.) was dissolved.

Thereafter, a mixed liquid obtained by adding to the solution 30 parts of a tetrafluoroethylene resin powder (trade name: Lubron L-2, manufactured by Daikin Industries, Ltd.) was allowed to pass through a high-pressure disperser (trade name: Microfluidizer M-110EH, manufactured by Microfluidics Corp.) to obtain a dispersion liquid.

Thereafter, 70 parts of the compound represented by the formula (F), 30 parts of 1,1,2,2,3,3,4-heptafluorocyclopentane and 30 parts of 1-propanol were added to the dispersion liquid and a resultant liquid was filtrated with a polyflon filter (trade name: PF-040, manufactured by Advantec Toyo Kaisha, Ltd.) to prepare a coating liquid for a surface layer (coating liquid for protective layer).

Example 20

An electrophotographic photosensitive member and a sample sheet of Example 20 were prepared in the same manner as in Example 1 except that a coating liquid for a surface layer (coating liquid for protective layer), the coating liquid prepared by the method described below, was used in the formation of the surface layer (protective layer) in Example 1, and the evaluation of the residual potential, the ghost level and the adhesion was conducted. The results are shown in Table 2.

95 parts of the compound represented by the following formula (L), 5 parts of a vinylester compound (manufactured by Tokyo Chemical Industry Co., Ltd.) which is the compound represented by the following formula (M), 3.5 parts of a siloxane-modified acrylic compound (trade name: BYK-3550, manufactured by BYK Japan KK), 5 parts of a urea compound represented by the following formula (N), 200 parts of 1-propanol and 100 parts of 1,1,2,2,3,3,4-heptafluorocyclopentane (trade name: ZEORORA H, manufactured by Zeon Corporation)

were mixed and then stirred.

Thereafter, the solution was filtrated with a polyflon filter (trade name: PF-020, manufactured by Advantec Toyo Kaisha, Ltd.) to prepare a coating liquid for a surface layer (coating liquid for protective layer).

(L)

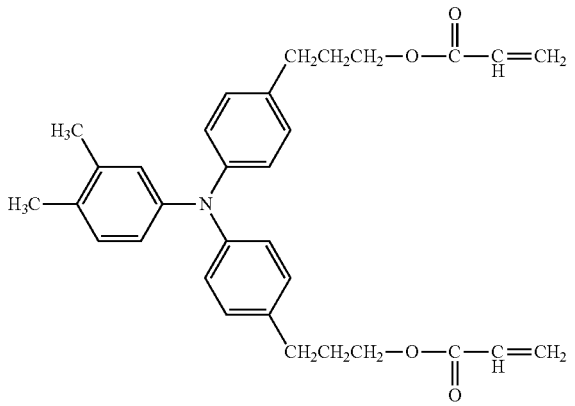

(M)

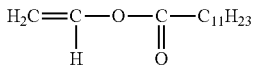

(N)

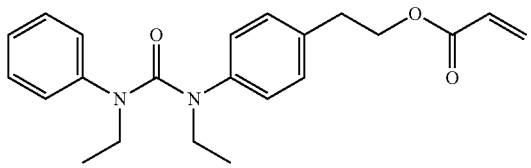

The charge transporting layer was dip-coated with the coating liquid for a surface layer to obtain a coating film, and the obtained coating film was dried at 50° C. for 10 minutes. After that, the coating film was irradiated with an electron beam for 1.6 seconds under a nitrogen atmosphere under conditions of an acceleration voltage of 70 kV and a beam current of 5.0 mA while rotating the support (object to be irradiated) with a rotational speed of 200 rpm. An absorbed dose of the electron beam measured at this time was 15 kGy. Thereafter, the coating film was heated under a nitrogen atmosphere such that the time taken to raise a temperature of the coating film from 25° C. to 117° C. was 30 seconds. The oxygen concentration from the irradiation with the electron beam to the heat treatment was 15 ppm or less. Subsequently, the coating film was naturally cooled in the air until the temperature decreases to 25° C., and a heat treatment was performed for 30 minutes under conditions for making the temperature of the coating film 105° C. to form a protective layer (surface layer) having a film thickness of 5 μm.

Example 21

An electrophotographic photosensitive member and a sample sheet of Example 21 were prepared in the same manner as in Example 1 except that the electro-conductive layer described below was provided between the support and the undercoat layer in Example 1, and the evaluation of the residual potential, the ghost level and the adhesion was conducted. The results are shown in Table 2.

A dispersion liquid was prepared by dispersing 57 parts of a titanium oxide particle having an enveloping layer (trade name: Passtran LRS, manufactured by MITSUI MINING & SMELTING CO., LTD.), 35 parts of a resol type phenolic resin (trade name: PHENOLITE J-325, manufactured by DIC corporation (former Dainippon Ink and Chemicals, Inc.), methanol solution having solid content of 60%) and 33 parts of 2-methoxy-1-propanol with a sand mill which uses a glass bead having a diameter of 1 mm for 3 hours. The average particle diameter of the powder contained in the dispersion liquid was 0.30 μm.

To the dispersion liquid, a liquid obtained by dispersing 8 parts of a silicone resin (trade name: Tospearl 120, manufactured by Momentive Performance Materials Japan LLC. (former Toshiba Silicone Co., Ltd.)) in 8 parts of 2-methoxy-1-propanol was added.

Further, 0.008 parts of a silicone oil (trade name: SH 28 PA, manufactured by Dow Corning Toray Co., Ltd. (former Toray Silicone Co., Ltd.)) was added thereto.

The aluminum cylinder was coated with the dispersion liquid thus prepared by a dipping method, and the dispersion liquid on the aluminum cylinder was cured by heating for 30 minutes in a hot air dryer in which the temperature was adjusted to 150° C. to cure the coating film of the dispersion liquid, and an electro-conductive layer having a film thickness of 30 μm was thereby formed.

Example 22

An electrophotographic photosensitive member of Example 22 was prepared in the same manner as in Example 1 except that an aluminum cylinder processed by the method described below was used as the support in Example 1, and the evaluation of the residual potential and the ghost level was conducted. The results are shown in Table 2.

A cylindrical aluminum cylinder (diameter of 30 mm, length of 357.5 mm and a wall thickness of 0.7 mm) was attached to a lathe and cut processing was performed with a diamond sintered cutting tool (tip R of 20 mm). In the cut processing, the number of revolutions of the main shaft was 3000 rpm, the feeding speed of the cutting tool was 5 mm/rev.

Example 23

An electrophotographic photosensitive member of Example 23 was prepared in the same manner as in Example 1 except that an aluminum cylinder processed by the method described below was used as the support in Example 1, and the evaluation of the residual potential and the ghost level was conducted. The results are shown in Table 2.

A cylindrical aluminum cylinder (diameter of 30 mm, length of 357.5 mm and a wall thickness of 0.7 mm) was attached to a lathe and cut processing was performed with a diamond sintered cutting tool so that the aluminum cylinder has an outer diameter of 30.0±0.02 mm, a deflection accuracy of 15 μm and a surface roughness of Rz=0.2 μm. In the cut processing, the number of revolutions of the main shaft was 3000 rpm, the feeding speed of the cutting tool was 0.3 mm/rev and processing time was 24 seconds excluding the time for attachment and detachment of the workpiece.

Measurement of the surface roughness was conducted according to JIS B 0601 using a surface roughness measuring instrument SURFCORDER SE3500 manufactured by Kosaka Laboratory Ltd. and setting cut off to 0.8 mm and a measurement length to 8 mm.

A liquid homing treatment was performed on the obtained aluminum cut tube using a liquid (wet) homing apparatus under the following conditions.

<Liquid Horning Conditions>

Abrasive grain of polishing material=spherical alumina bead having an average particle diameter of 30 μm (trade name: CB-A30S, manufactured by Showa Denko K.K.)

Suspension medium=water

Polishing material/suspension medium=⅕ (volume ratio)

Number of revolutions of aluminum cut tube=1.67 $S^{-1}$

Air blow pressure=0.15 MPa

Moving speed of gun=13.3 mm/sec.

Distance between gun nozzle and aluminum tube=200 mm

Discharge angle of abrasive grain for horning=45°

Number of projection of polishing liquid=1 (One way)

With respect to the surface roughness of the cylinder after the horning, Rmax was 2.53 μm, Rz was 1.51 μm, Ra was 0.23 μm and Sm was 34 μm. The aluminum cylinder was dipped once into a dipping vat filled with pure water immediately after the wet horning treatment was applied in the manner as described above, the aluminum cylinder was then drawn up, and pure water shower washing was applied to the cylinder before the cylinder was dried. Thereafter, warm water of 85° C. was discharged from a discharge nozzle to the inner surface of the base to make the warm water into contact with the inner surface, and the outer surface was dried. Thereafter, the inner surface of the base was air-dried.

The aluminum cylinder on which surface processing was performed in the manner as described above was used as the support of the electrophotographic photosensitive member.

Comparative Example 1

An electrophotographic photosensitive member and a sample sheet of Comparative Example 1 were prepared in the same manner as in Example 1 except that the strontium titanate particle S-1A used for the coating liquid for an undercoat layer was changed to the particle S-6A in Example 1, and the evaluation of the residual potential, the ghost level and adhesion was conducted.

The results are shown in Table 2.

Comparative Example 2

An electrophotographic photosensitive member and a sample sheet of Comparative Example 2 were prepared in the same manner as in Example 1 except that the mixing ratio of the strontium titanate particle S-1A and the titanium oxide particle used for the coating liquid for an undercoat layer in Example 1 was changed to the ratio below, and the evaluation of the residual potential, the ghost level and the adhesion was conducted.

120 parts of strontium titanate particle S-1A 0 parts of Titanium oxide particle T-1

The results are shown in Table 2.

Comparative Example 3

An electrophotographic photosensitive member and a sample sheet of Comparative Example 3 were prepared in the same manner as in Example 1 except that the mixing ratio of the strontium titanate particle S-1A and the titanium oxide particle used for the coating liquid for an undercoat layer in Example 1 was changed to the ratio below, and the evaluation of the residual potential, the ghost level and the adhesion was conducted.

0 parts of strontium titanate particle S-1A 120 parts of titanium oxide particle T-1

The results are shown in Table 2.

Comparative Example 4

An electrophotographic photosensitive member and a sample sheet of Comparative Example 4 were prepared in the same manner as in Example 1 except that 15 parts of the butyral resin and 15 parts of the blocked isocyanate each used for the coating liquid for an undercoat layer in Example 1 were changed to 30 parts of a vinyl chloride-vinyl acetate copolymer (manufactured by Union Carbide Corporation), and the evaluation of the residual potential, the ghost level and the adhesion was conducted. The results are shown in Table 2.

TABLE 2

| | Evaluation | | | |
|---|---|---|---|---|
| | Residual potential [V] | Ghost (difference in concentration) Vh (2nd round) − Vh (1st round) | | Adhesion |
| Example 1 | −34 V | −3 V | AA | 95% AA |
| Example 2 | −32 V | −3 V | AA | 80% A |
| Example 3 | −40 V | −10 V | A | 95% AA |
| Example 4 | −40 V | −10 V | A | 95% AA |
| Example 5 | −72 V | −15 V | A | 95% AA |
| Example 6 | −38 V | −5 V | AA | 80% A |
| Example 7 | −51 V | −10 V | A | 95% AA |
| Example 8 | −68 V | −10 V | A | 95% AA |
| Example 9 | −52 V | −10 V | A | 95% AA |
| Example 10 | −35 V | −5 V | AA | 80% A |
| Example 11 | −70 V | −10 V | A | 80% A |
| Example 12 | −35 V | −5 V | AA | 90% AA |
| Example 13 | −64 V | −5 V | A | 90% AA |
| Example 14 | −40 V | −5 V | AA | 95% AA |

TABLE 2-continued

| | Evaluation | | | | |
|---|---|---|---|---|---|
| | Residual potential [V] | Ghost (difference in concentration) Vh (2nd round) − Vh (1st round) | | Adhesion | |
| Example 15 | −42 V | −5 V | AA | 95% | AA |
| Example 16 | −48 V | −5 V | AA | 95% | AA |
| Example 17 | −50 V | −5 V | AA | 95% | AA |
| Example 18 | −50 V | −5 V | AA | 95% | AA |
| Example 19 | −50 V | −5 V | AA | 95% | AA |
| Example 20 | −50 V | −5 V | AA | 95% | AA |
| Example 21 | −50 V | −5 V | AA | 95% | AA |
| Example 22 | −50 V | −5 V | AA | No sheet | |
| Example 23 | −50 V | −5 V | AA | No sheet | |
| Comparative Example 1 | −112 V | −15 V | B | 95% | AA |
| Comparative Example 2 | −40 V | −10 V | A | 70% | B |
| Comparative Example 3 | −142 V | −17 V | B | 95% | AA |
| Comparative Example 4 | −40 V | −5 V | AA | 70% | B |

As shown in Table 2, an electrophotographic photosensitive member, a process cartridge and an electrophotographic apparatus having the undercoat layer containing a strontium titanate particle and a titanium oxide particle of the present invention suppresses the residual potential, prevents the ghost image from being generated and retains sufficient adhesion to the charge generating layer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-185360, filed Sep. 26, 2017, which is hereby incorporated by reference herein in its entirety.

What is claimed is:

1. An electrophotographic photosensitive member, comprising:

a support, an undercoat layer, and a photosensitive layer in this order;

the undercoat layer comprising a binder resin, a titanium oxide particle and a strontium titanate particle; and the photosensitive layer comprising a polyvinyl butyral resin, wherein the strontium titanate particle has a maximum peak in a CuKα characteristic X-ray diffraction pattern at a position of $2\theta=32.20\pm0.20$ where θ represents a Bragg angle, and a half-value width of the maximum peak is 0.10 to 0.50 deg.

2. The electrophotographic photosensitive member according to claim 1, wherein the half-value width is 0.10 to 0.35 deg.

3. The electrophotographic photosensitive member according to claim 1, wherein a total content of the strontium titanate particle and the titanium oxide particle in the undercoat layer is 70% by mass or more based on a content of a metal oxide in the undercoat layer, and a mass ratio of a content of the titanium oxide particle MTi and a content of the strontium titanate particle MSr in the undercoat layer satisfy $0.25\leq MSr/MTi\leq 9.0$.

4. The electrophotographic photosensitive member according to claim 1, wherein the strontium titanate particle contained in the undercoat layer is surface treated with a silane coupling agent.

5. A process cartridge integrally supporting an electrophotographic photosensitive member and at least one unit selected from the group consisting of a charging unit, a developing unit, a transfer unit and a cleaning unit;

the electrophotographic photosensitive member having a support, an undercoat layer and a photosensitive layer in this order;

the process cartridge being detachably attachable to an electrophotographic apparatus main body;

the undercoat layer comprising a binder resin, a titanium oxide particle and a strontium titanate particle; and the photosensitive layer comprising a polyvinyl butyral resin, wherein the strontium titanate particle has a maximum peak in a CuKα characteristic X-ray diffraction pattern at a position of $2\theta=32.20\pm0.20$ where θ represents a Bragg angle, and a half-value width of the maximum peak is 0.10 to 0.50 deg.

6. An electrophotographic apparatus, comprising:

an electrophotographic photosensitive member, a charging unit, an exposing unit, a developing unit, and a transfer unit;

the electrophotographic photosensitive member having a support, an undercoat layer and a photosensitive layer in this order;

the undercoat layer comprising a binder resin, a titanium oxide particle and a strontium titanate particle; and the photosensitive layer comprising a polyvinyl butyral resin, wherein the strontium titanate particle has a maximum peak in a CuKα characteristic X-ray diffraction pattern at a position of $2\theta=32.20\pm0.20$ where θ represents a Bragg angle, and a half-value width of the maximum peak is 0.10 to 0.50 deg.

7. The electrophotographic apparatus according to claim 6, wherein the charging unit comprises a charging roller disposed so as to contact the electrophotographic photosensitive member, said charging unit being configured to charge the electrophotographic photosensitive member by applying only direct-current voltage to the charging roller.

* * * * *